US008707649B2

(12) United States Patent
Wilkie et al.

(10) Patent No.: US 8,707,649 B2
(45) Date of Patent: Apr. 29, 2014

(54) MORTARLESS MODULAR MASONRY SIDING SYSTEM

(75) Inventors: Pierre Wilkie, Westmount (CA); Martine Morand, Montreal (CA); Ricardo Borja, Montreal (CA); Mike Streicher, Lasalle (CA); Bertin Castonguay, Magog (CA); Michel Bouchard, Rivière-des-Prairies (CA); Pierre Luc Duchesne, Shefford (CA); Benoit Deragon, Granby (CA)

(73) Assignee: DECO NAT Inc., Bromont, CA (US)

( * ) Notice: Subject to any disclaimer, the term of this patent is extended or adjusted under 35 U.S.C. 154(b) by 0 days.

(21) Appl. No.: 13/451,965

(22) Filed: Apr. 20, 2012

(65) Prior Publication Data

US 2012/0272598 A1 Nov. 1, 2012

Related U.S. Application Data

(60) Provisional application No. 61/477,436, filed on Apr. 20, 2011.

(51) Int. Cl.
*E04D 1/00* (2006.01)
*E04F 13/08* (2006.01)

(52) U.S. Cl.
CPC ..... *E04F 13/0869* (2013.01)
USPC ..... 52/533

(58) Field of Classification Search
CPC ..... E04F 13/0869; E04F 13/0864; E04F 13/0889
USPC ..... 52/302.3, 518, 533
See application file for complete search history.

(56) References Cited

U.S. PATENT DOCUMENTS

| | | | | |
|---|---|---|---|---|
| 2,135,118 | A | | 11/1938 | Stewart |
| 2,482,835 | A | * | 9/1949 | Bremer ..... 52/533 |
| 2,624,298 | A | * | 1/1953 | Farren ..... 52/533 |
| 2,872,804 | A | | 2/1959 | Baldanza |
| 3,613,326 | A | | 10/1971 | Mollman |
| 4,553,366 | A | * | 11/1985 | Guerin ..... 52/506.08 |
| 4,665,675 | A | * | 5/1987 | Kelly ..... 52/534 |
| 5,885,502 | A | | 3/1999 | deAngelis et al. |

(Continued)

FOREIGN PATENT DOCUMENTS

| | | |
|---|---|---|
| CA | 1200706 | 2/1986 |
| CA | 2532845 | 6/2007 |

(Continued)

*Primary Examiner* — Andrew Triggs
(74) *Attorney, Agent, or Firm* — Joachim T. Fritz; Borden Ladner Gervais LLP

(57) ABSTRACT

A pre-cast siding panel for mortarless application to a building structure is disclosed, which includes a structure for capturing and draining infiltrated water away from the building structure. In a preferred embodiment, the siding panel includes a cast facing panel made of settable material and having a front face exposed in an installed condition of the panel and top, bottom and side edges for engagement with like panels positioned adjacent thereto; and a supporting spacer partially embedded in the rear surface of the facing panel, the spacer including a mounting portion for fastening the siding panel to the building structure and a water management portion for managing infiltrated water away from the building structure, by capturing infiltrated water which has seeped past the front face along one or more of the edges and draining the captured infiltrated water away from the building structure.

22 Claims, 7 Drawing Sheets

(56) References Cited

U.S. PATENT DOCUMENTS

| | | | | |
|---|---|---|---|---|
| 6,951,086 | B2 | 10/2005 | Passeno | |
| 7,472,523 | B2 * | 1/2009 | Beck | 52/748.1 |
| 7,596,919 | B1 * | 10/2009 | Vande Hey et al. | 52/533 |
| 7,694,477 | B2 * | 4/2010 | Kuelker | 52/302.3 |
| 8,042,309 | B2 | 10/2011 | Wolf et al. | |
| 2009/0193742 | A1 * | 8/2009 | Wolf et al. | 52/311.1 |
| 2010/0146893 | A1 * | 6/2010 | Dickinson | 52/302.3 |
| 2010/0192495 | A1 | 8/2010 | Huff et al. | |
| 2011/0239578 | A1 * | 10/2011 | Wolf et al. | 52/588.1 |
| 2012/0272598 | A1 * | 11/2012 | Wilkie et al. | 52/302.3 |

FOREIGN PATENT DOCUMENTS

| | | |
|---|---|---|
| CA | 2714078 | 8/2009 |
| CA | 2661233 | 3/2010 |
| CA | 2728902 | 7/2011 |

* cited by examiner

MORTARLESS MODULAR MASONRY SIDING SYSTEM

CROSS REFERENCE TO RELATED APPLICATIONS

This application claims the benefit of priority of U.S. Provisional Patent Application No. 61/477,436 filed Apr. 20, 2011, which is incorporated herein by reference in its entirety.

FIELD OF THE INVENTION

The invention relates to the construction field and more particularly to precast siding panels and a mortarless modular masonry siding system.

BACKGROUND OF THE INVENTION

Precast siding panels are generally used for the exterior finishing of residential or commercial buildings. Known siding panels generally include a facing panel with cast design features simulating natural stone or brick or other masonry elements commonly used for the exterior finish of buildings. The facing panel is either directly mounted to the building wall or by way of stand-off or spacer elements which are mounted to the wall. The facing panels are either suspended from these elements or permanently connected therewith through embedded interlocking elements. A cast veneer panel including a backing panel and a facing panel cast on the backing panel and interlocked therewith is disclosed in U.S. Pat. No. 8,042,309. The facing panel includes at least one design element. This cast veneer panel may include stand-off dimples to create a ventilation gap between the building and a back surface of the backing panel. The veneer panel can be mounted to a building with or without subsequent mortar application between the individual panels and/or the design elements. However, in the mortarless application mode, infiltration of water between the individual veneer panels is possible, especially under wind pressure. Although the infiltrated water can drain off under gravity in the ventilation gap, it will nevertheless come in contact with the building structure, at least at the stand-off dimples, increasing the danger of water infiltration into the building structure through breaks in the building wrap.

SUMMARY OF THE INVENTION

It is now an object of the invention to overcome at least one of the disadvantages found in the prior art.

In particular, it is an object of the invention to provide a pre-cast siding panel for mortarless application, which includes a water management structure for managing infiltrated water away from the building structure, by capturing infiltrated water away from the building structure, which means before it can reach the building structure, and draining the captured infiltrated water away from the building structure, in order to avoid contact of infiltrated water with the building structure.

In a preferred embodiment, the invention provides a siding panel for the assembly of a mortarless modular siding on a building structure, comprising a facing panel made of settable material and a supporting spacer partially embedded in the rear surface of the facing panel. The facing panel has a front face exposed in an installed condition of the panel and a rear surface directed towards the building structure in the installed condition. The facing panel further has top, bottom and side edges for proximal placement to like panels positioned adjacent thereto, in order to achieve a substantially continuous siding surface.

The spacer includes a mounting portion for fastening the siding panel to the building structure and a water management portion for, away from the building structure, capturing infiltrated water which has seeped past the front face along the top edge and draining the captured infiltrated water.

The mounting water management portions are preferably integral portions of the supporting spacer.

Preferably, the mounting portion is a metal plate with anchoring tabs embedded into the facing panel and the water management portion is a plastics structure with anchoring tabs embedded into the facing panel.

The water management portion preferably engages the rear surface along the top edge to define a trough for capturing the infiltrated water. The trough preferably extends substantially over a whole width of the facing panel. More preferably, the trough further extends along one of the side edges for capturing water, which has seeped past the front face along the side edge.

In one embodiment, the trough includes a drainage opening and the water management portion further includes a drainage conduit connected to the drainage opening for channelling water flowing through the drainage opening toward the bottom edge.

The trough is preferably U-shaped for capturing water drained from the drainage conduits of a siding panel positioned directly above.

The supporting spacer preferably includes a mounting flange formed by overlapping sections of the mounting and water management portions, for reinforcement of the supporting spacer at the point of securement to the building structure. The mounting flange preferably extends along a top edge of the siding panel and the supporting spacer preferably further includes coupling elements for slidingly coupling the bottom edge of the siding panel with the mounting flange of a like siding panel positioned immediately below.

Preferably, the mounting flange and coupling member are parallel for automatic horizontal alignment of horizontally stacked like panels.

The invention also provides a mortarless modular siding, comprising stacked rows of the siding panels in accordance with the invention.

The invention further provides a method of mounting a modular siding on a building structure, including the steps of obtaining multiple siding panels in accordance with the invention, mounting a horizontal row of at least two side by side siding panels on the building structure; and installing subsequent rows of like siding panels by interlocking the coupling member of each siding panel with the mounting portion of the horizontal row of panels, sliding the siding panel on the horizontal row to a desired location adjacent another like panel and fastening the mounting flange of the siding panel to the building structure.

BRIEF DESCRIPTION OF THE DRAWINGS

Exemplary embodiments of the invention will be further discussed in detail below with reference to the drawings, wherein.

DESCRIPTION OF THE PREFERRED EMBODIMENTS

Detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1A:
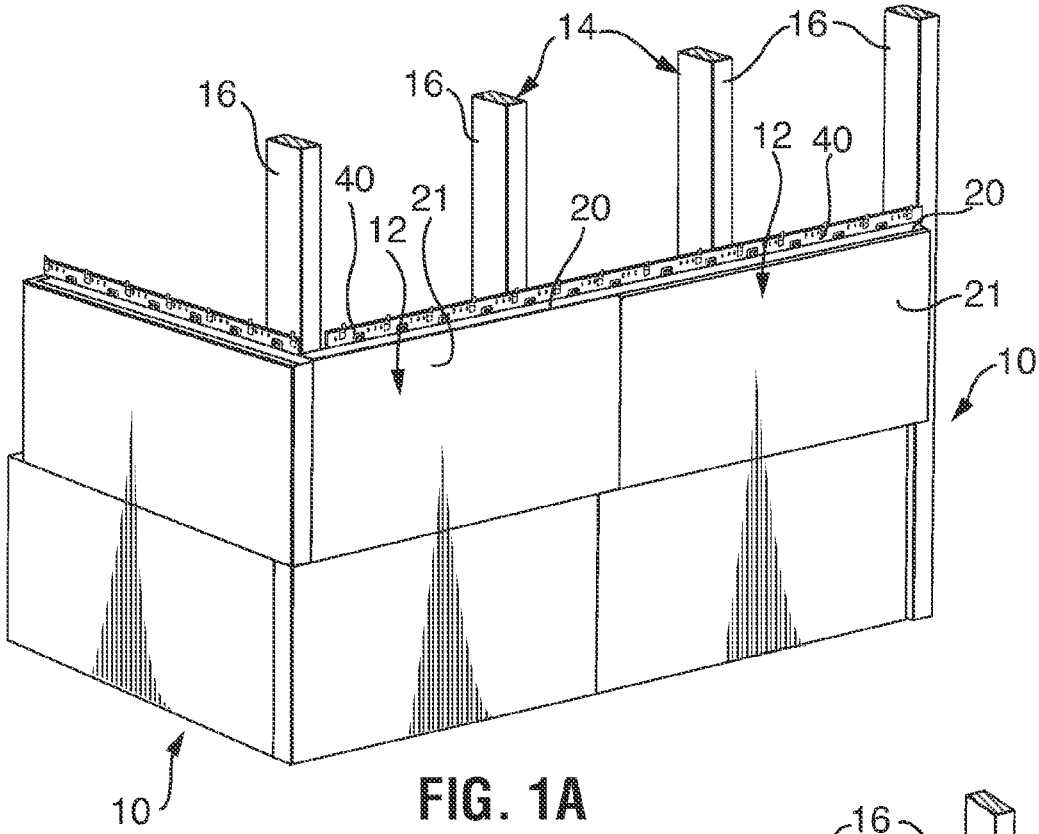
FIGS. 1A and 1B are perspective views of the mortarless modular masonry siding system in accordance with the invention, using differently shaped siding panels in accordance with the invention.
Figure 1B:
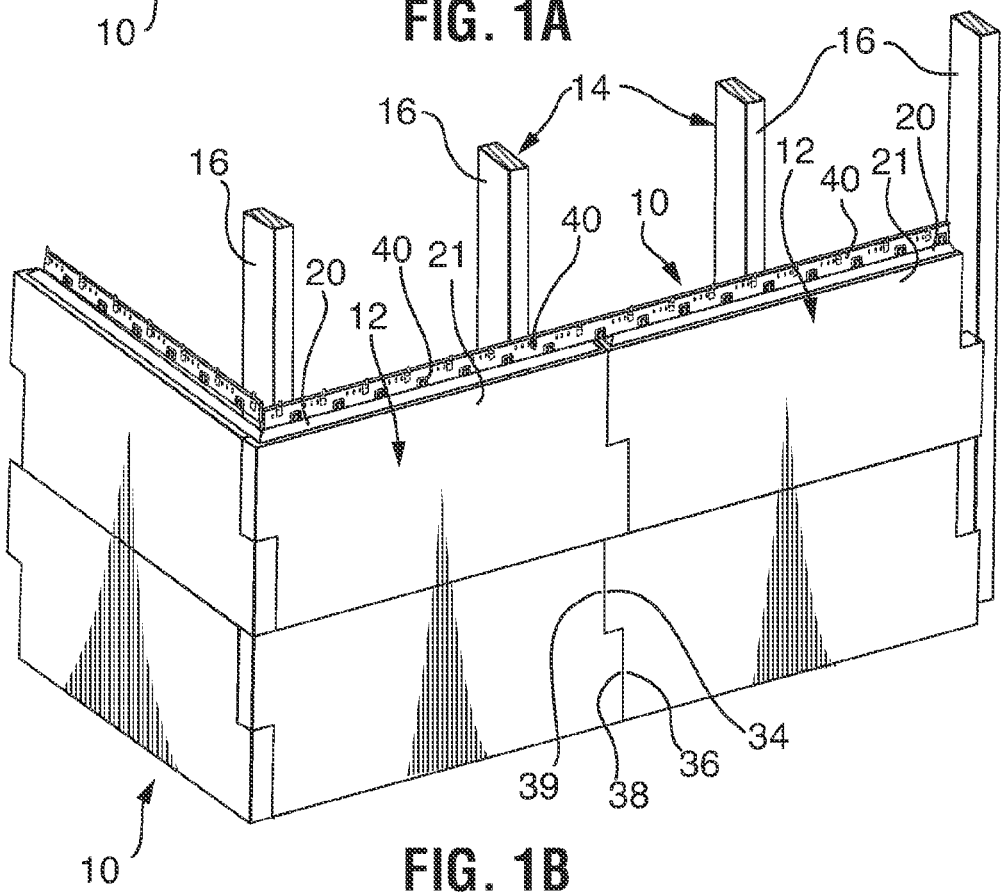

In accordance with the present invention, and with reference to FIGS. 1A and 1B, a modular siding system 10 is disclosed. The modular siding system 10 allows for the convenient and secure attachment of modular siding panels 12 with a concrete facing to a static building structure 14 in a manner creating a concrete outer surface without the need to use mortar for sealing the siding and for holding the siding panels together. In order to minimize the chance of water damage to the building structure by water infiltrated across the siding, for example through the mortarless joints, the modular siding system further allows for the management of infiltrated water away from the building structure, namely the capture and drainage of infiltrated water away from the building structure.

In accordance with the disclosed invention, the modular siding panels 12 are stacked, automatically aligned and coupled at the bottom of each siding panel 12 to a vertically adjacent siding panel 12 or a starter strip or starter rail 90 (see FIGS. 5A and 5B), which is attached to the building structure 14 and forms the base of the siding system 10 (see FIGS. 1A and 1B).

Referring to FIGS. 1A, 1B, 2, 3A, 3B, 4A to 4D, each of the siding panels 12 is substantially planar and includes a facing panel 20 made of settable material with a facing surface 21 and a supporting spacer 40 connected with the facing panel 20 along a back surface 22 of the facing panel. Each of the siding panels 12 includes the supporting spacer 40 partially embedded in the facing panel for attachment to studs 16 positioned in the back-up wall (that is, wood stud, steel stud, cement structure or other) of the static building structure 14. The supporting spacer 40 includes a mounting portion 42 for fastening the siding panel 12 to a vertical supporting surface of the building structure 14 and a water management or water evacuation portion 60 for managing infiltrated water away from the building structure by capturing infiltrated water which has seeped past the front face and draining the captured water away from the building structure 14. Thus, the water management portion 60 is for capturing the infiltrated water away from the building structure and draining it, also away from the building structure. The mounting and water management portions 42, 60 can be integral portions of the supporting spacer 40, or separate elements combined into the supporting spacer 40, such as a mounting portion 42 formed as a metal plate 43 with anchoring tabs 44 embedded into the facing panel 20 and a water management portion 60 formed as a plastics structure with anchoring tabs 62 embedded into the facing panel 20. The anchoring tabs 44 and/or 62 preferably include interference structures for locking the anchoring tabs into the set material of the facing panel 20, such as openings 45 in anchoring tabs 44 through which the settable material of the facing panel extends, or enlarged embedded ends 61, for example in the shape of a hook, a barb or barbs on anchoring tabs 62.

In the illustrated embodiment, the supporting spacer 40 includes a mounting flange 46 for securing of the siding panel 12 to the building structure 14, which mounting flange 46 is formed by overlapping sections of the mounting and water management portions 42, 60, for reinforcement of the supporting spacer at the point of securement to the building structure. The individual components of the siding panels 12 will be described in more detail below.

Facing Panel

Figure 2A:
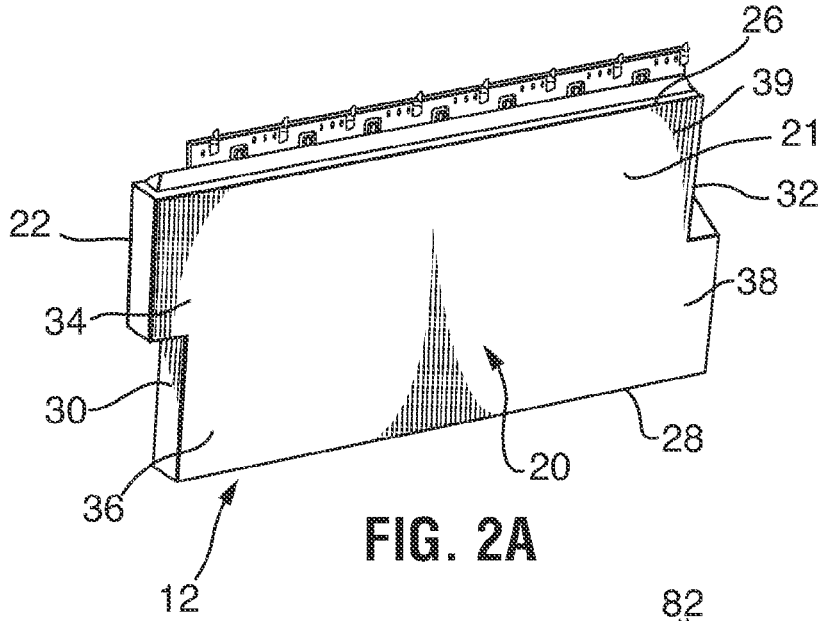
FIGS. 2A and 2B are perspective views of a siding panel as shown in FIG. 1B, with the facing panel shown in phantom lines in FIG. 2B, exposing the supporting spacer.
Figure 2B:
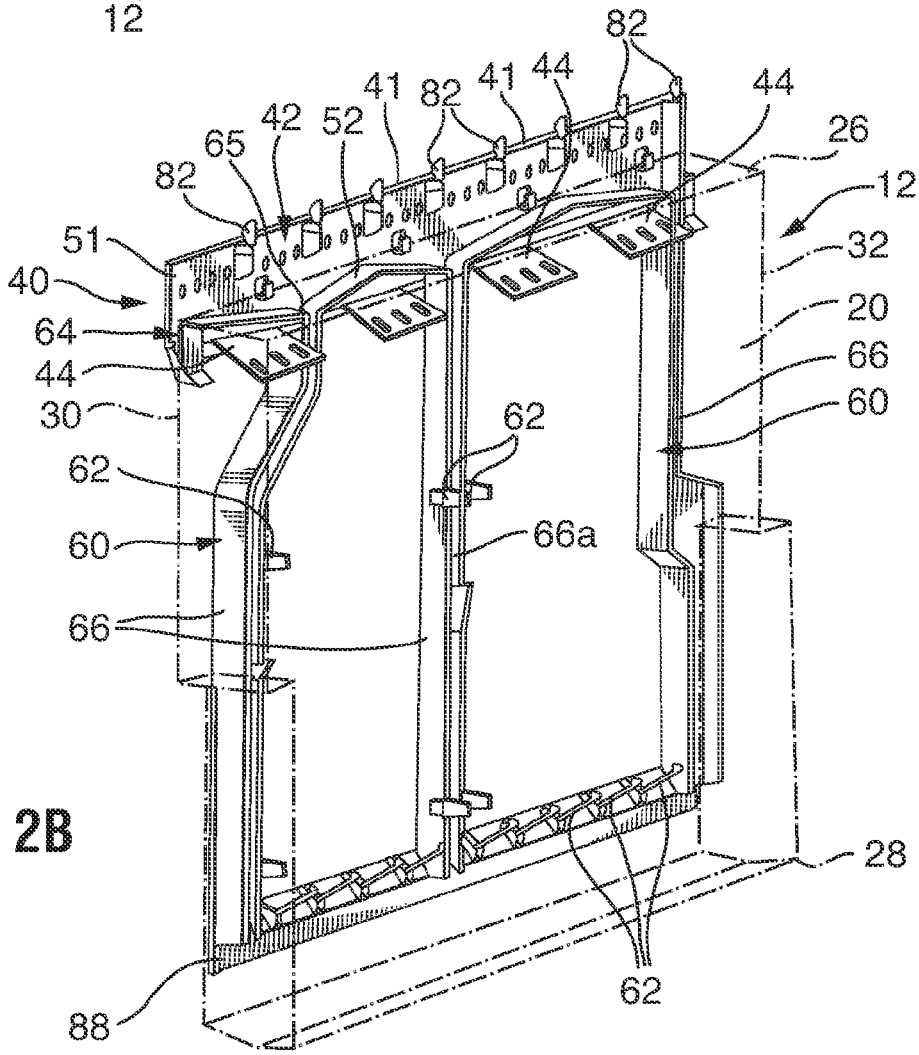

Referring now to FIGS. 1B, 2A and 2B, the facing panel 20 includes a facing surface 21, a back surface 22, a top edge 26 extending between the front surface 21 and the back surface 22, a bottom edge 28 extending between the facing surface 21 and the back surface 22, and first and second side edges 30, 32 extending between the facing surface 21 and the back surface 22. The facing panel 20 may be rectangular in shape, as shown in FIG. 1A, or have a Z-shape as shown in FIG. 1B and 2A. Other shapes, such as square or irregular are also possible, as long as the shape can be assembled into a continuous surface covering with like siding panels of identical shape. The facing panel 20 may be made of any settable material which can be molded to achieve the desired appearance of the siding panels, especially any decorative embossment or three dimensional shaping of the facing surface 21 to give the siding panel 12 the appearance of natural stone or of other masonry surfaces. Examples of settable materials are wet cast concrete, dry cast concrete, concrete mixtures including fibrous or plastic materials, resinous mixtures, etc.

In the Z-shaped embodiment of the facing panel 20 as illustrated in FIGS. 1B and 2A, the first and second side edges 30, 32, which ultimately define the first and second side edges 30, 32 of the siding panel 12, are formed with an interlocking profile. In this preferred embodiment, the first side edge 30 is provided with a protruding upper section 34 adjacent the top edge 26 of the facing panel 20 and a recessed lower section 36 adjacent the bottom edge 28 of the facing panel 20. Similarly, the second side edge 32 is provided with a protruding lower section 38 adjacent the bottom edge 28 of the facing panel 20 of the siding panel 12 and a recessed upper section 39 adjacent the top edge 26 of the facing panel 20 of the siding panel 12. The protruding upper section 34 and recessed lower section 36 of the first side edge 30 are shaped to interlock with the respective recessed upper section 39 and the protruding lower section 38 of the second side edge 32 creating an enclosed siding surface with no space between the first side edge 30 and the second side edge 32 of adjacent facing panels 20 of the siding panels 12 (FIG. 1B).

Preferably, the protruding and recessed sections described above are dimensioned such that the protrusion and/or recess are comparable in size to the thickness of the facing panel. This allows for the creation of an interlocked yet smooth corner assembly.

As discussed above, each facing panel 20 is formed with a top edge 26 and a bottom edge 28. As with the first side edge 30 and the second side edge 32, the top edge 26 and the bottom edge 28 are shaped and dimensioned to form a mating relationship when the siding panels 12 are vertically stacked and horizontally abutted (see FIGS. 6 and 7). The top edge 26 and the bottom edge 28 define straight edges as they extend from the first side edge 30 to the second side edge 32.

As is apparent from FIGS. 4A to 4D, 6 and 7, the top edge 26 and the bottom edge 28 are shaped to taper downwardly as they extend from the back surface 22 to the facing surface 21. That means when the siding panel 12 is secured to a vertical supporting surface 15 of the static building structure 14, the top edge 26 has a downwardly sloping portion 27 which extends from the back surface 22 of the facing panel 20 and a horizontal portion which extends from the facing surface 21 of the facing panel 20. The downwardly sloping portion 27 defines a downwardly sloping surface along the top edge 26 of the facing panel 20. Similarly, the bottom edge 28 has a downwardly sloping portion 29, which extends from the back surface 22 of the facing panel 20 to define a downwardly facing downwardly sloping surface along the bottom edge 28 of the facing panel 20. As a result, when the top edge 26 is mounted next to a bottom edge 28 of an adjacent siding panel 12 and a continuous, closed siding surface is created, very little spacing remains between the top edge 26 and the bottom edge 28. In addition, the sloping nature of the top edge 26 and the bottom edge 28 as they extend from the back surface 22 of the facing panel 20 to the facing surface 21 of the facing panel 20 results in a sloping seam that counteracts the seepage of water between vertically adjacent siding panels 12. However, wind pressure may still be sufficient to push water through the seam until the infiltrated water reaches the back surface 22 of the facing panel 20. Should infiltrated water get trapped behind the siding of a building, significant, humidity related damage can occur, which is why the siding panel 12 of the invention is provided with an infiltrated water management structure for capturing and draining the infiltrated water before it can reach the building structure, which means away from the building structure as part of the supporting spacer, as will be discussed in the following.

Supporting Spacer

As is apparent from FIGS. 2B, 3 and 4A to 4D, the present modular siding system 10 employs a supporting spacer 40, preferably made of a combination of steel and plastic components, partially embedded in the facing panel 20 of the modular siding panels 12. The supporting spacer 40 facilitates secure attachment of the siding panels 12 to the vertical supporting surface 15. The supporting spacer 40 is positioned within each of the siding panels 12 during the manufacturing process and, as will be appreciated based upon the following disclosure, provides a water resistance barrier, a water management system, a self-ventilated system and a reinforcing mechanism.

Figure 6:
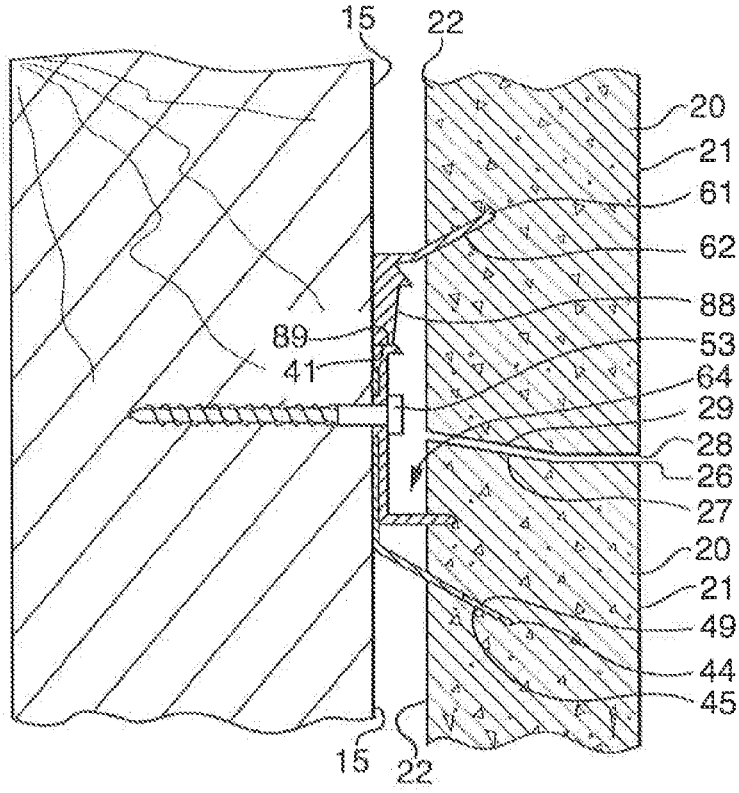
FIG. 6 is a partial cross-sectional view through a pair of vertically stacked siding panels illustrating the engagement of the bottom end of one supporting spacer with the top end of the other supporting spacer.
Figure 7:
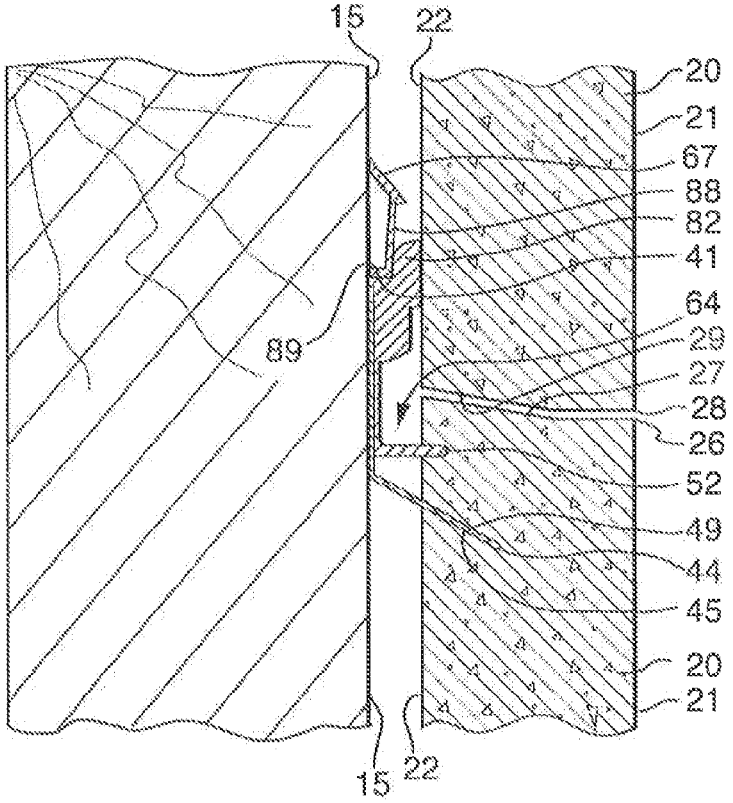
FIG. 7 is a partial cross-sectional view through the coupling elements of a pair of vertically stacked siding panels.

Referring to FIGS. 2B, 3 4A to 4D, 6 and 7, the supporting spacer 40 is molded with the facing panel 20 to form an integral one-piece siding panel 12. As will be appreciated based upon the following disclosure, the supporting spacer 40 provides a mechanism for securing top edge 26 of a lower siding panel 12 to the vertical supporting surface 15, while coupling to the bottom edge 28 of a like siding panel 12 positioned directly above (FIGS. 6 and 7). Even though all of the siding panels 12 are identical in a preferred embodiment of the siding system of the invention, it is also conceivable that siding panels with differently shaped facing panels can be included, as long as they combine to form a continuous siding surface. However, the supporting spacers 40 are preferably of identical construction for all siding panels and, thus, the supporting spacer 40 will be described with reference to only one of the siding panels 12.

Mounting Portion

The supporting spacer 40 is in the following described with reference to the orientation when the siding panel 12 is coupled to the vertical supporting surface 15. The supporting spacer 40 includes a mounting portion 42 for fastening the siding panel 12 to the vertical supporting surface 15 of the building structure 14 adjacent the top edge 26, and a water management portion 60 for managing infiltrated water away from the building structure. With the water management portion 60, infiltrated water which has seeped towards the back surface 22 is captured away from the building structure 14, which means before it comes into contact with the building structure and the captured water is then drained, again away from the building structure. The mounting and water management portions 42, 60 can be integral portions of the supporting spacer 40, or separate elements integrated into the supporting spacer 40, as illustrated in FIGS. 2B, 3 and 4A to 4D. In the illustrated embodiment, the mounting portion 42 is formed as a metal plate 43 with anchoring tabs 44 embedded into the facing panel 20. By forming the mounting portion from the metal plate 43, a reliable supporting of the siding panel 12 is achieved without any sagging due to material fatigue or excessive heat. It will be appreciated by the art skilled person that the siding panel 12, depending on geographic location of the installation and color of the facing panel 20, can become heated to elevated temperatures by sun exposure, at which temperatures plastics materials may be subject to sufficient softening to cause deformation or creep under the load of the facing panel. Although it is desirable to prevent sagging of the siding panels at elevated temperatures, it is even more desirable to maintain the siding panels reliably attached to the building structure in the case of a fire. By using a mounting portion made of metallic material, the siding panels will remain attached to the building structure for a much longer period of time during an incendiary incident, than if they were made of other materials much more easily deformed under heat, such as plastics. In the illustrated embodiment, the mounting portion 42 includes the mounting flange 46 for fastening to the building structure. The mounting flange 46 is formed by overlapping sections of the mounting and water management portions 42, 60, for reinforcement of the supporting spacer at the point of securement to the building structure. Moreover, the metal plate 43 of the mounting portion 42 is preferably provided with apertures 47 into which the sandwiched material of the water management portion 60 extends, in order to achieve an interlocked connection between the mounting and water management portions (see FIG. 4A). The siding panel 12 is fastened to the building structure 14 by way of a screw or bolt 53 (lag bolt for concrete structures), which tightly biases the mounting flange 46 against the supporting surface 15 of the building structure.

Water Management Portion

Figure 3:
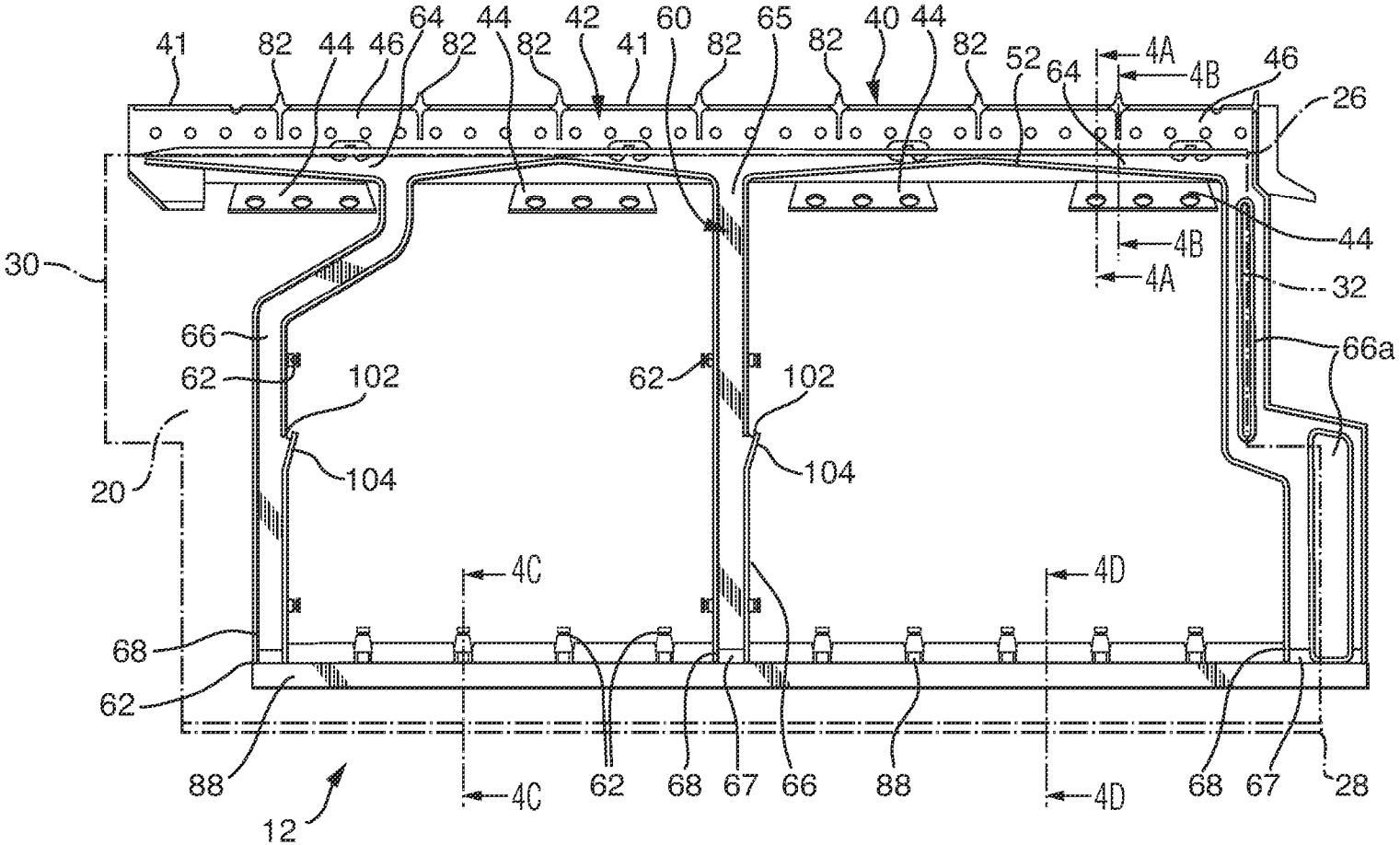
FIG. 3 is a front elevational view of the supporting spacer of FIG. 2B, with the connected facing panel shown in phantom lines.
Figure 4A:
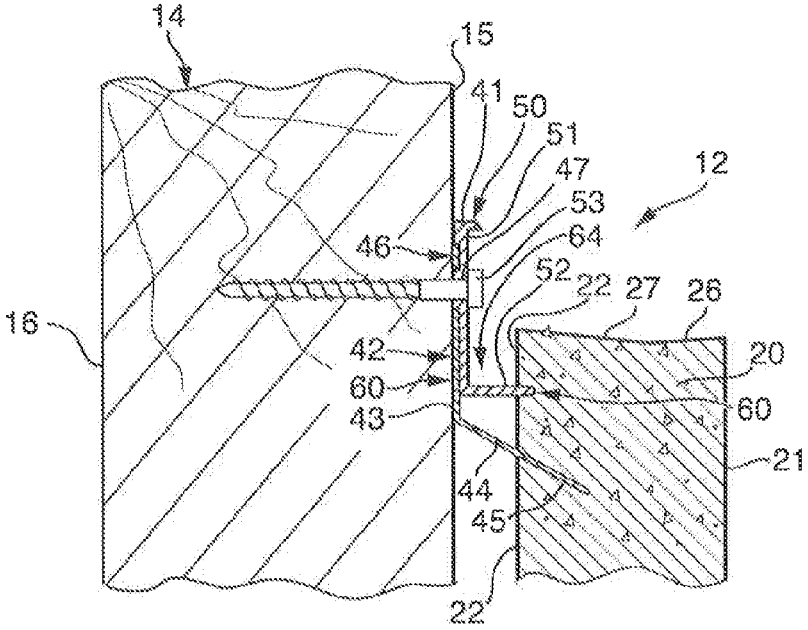
FIG. 4A is a partial cross-sectional view of the supporting spacer, taken along line 4A-4A in FIG. 3.
Figure 4B:
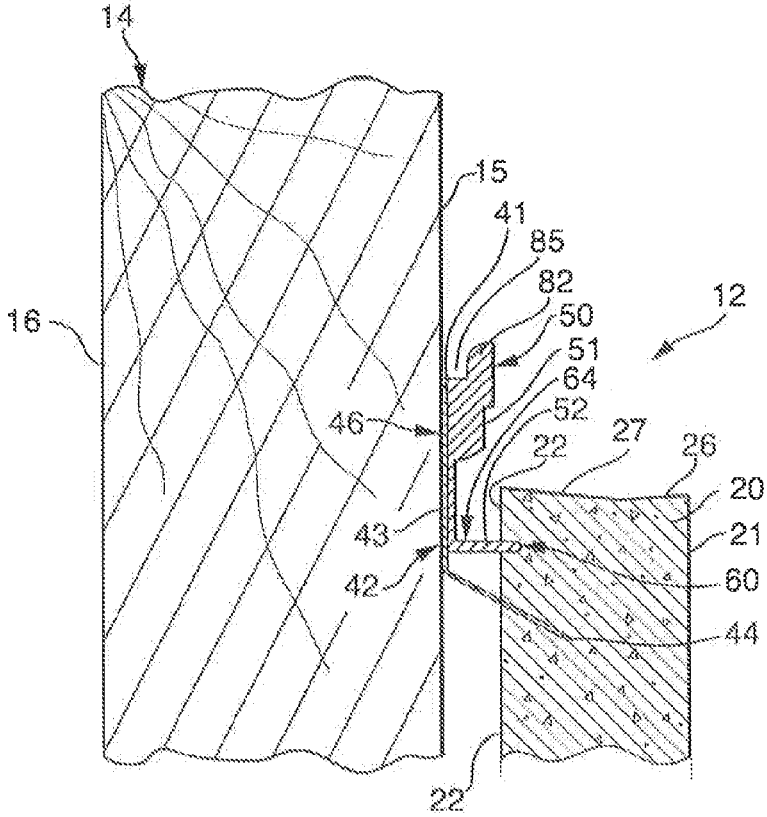
FIG. 4B is a partial cross-sectional view of the supporting spacer, taken along line 4B-4B in FIG. 3.
Figure 4C:
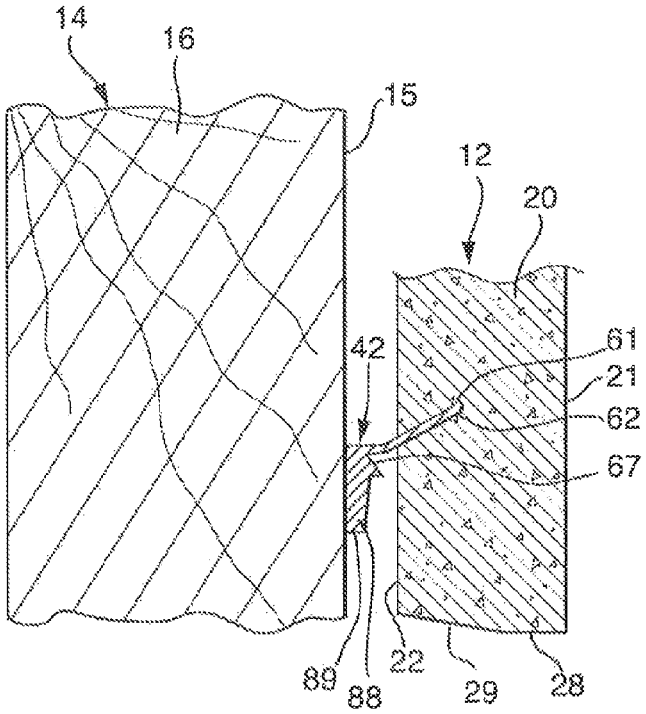
FIG. 4C is a partial cross-sectional view of the supporting spacer, taken along line 4C-4C in FIG. 3.
Figure 4D:
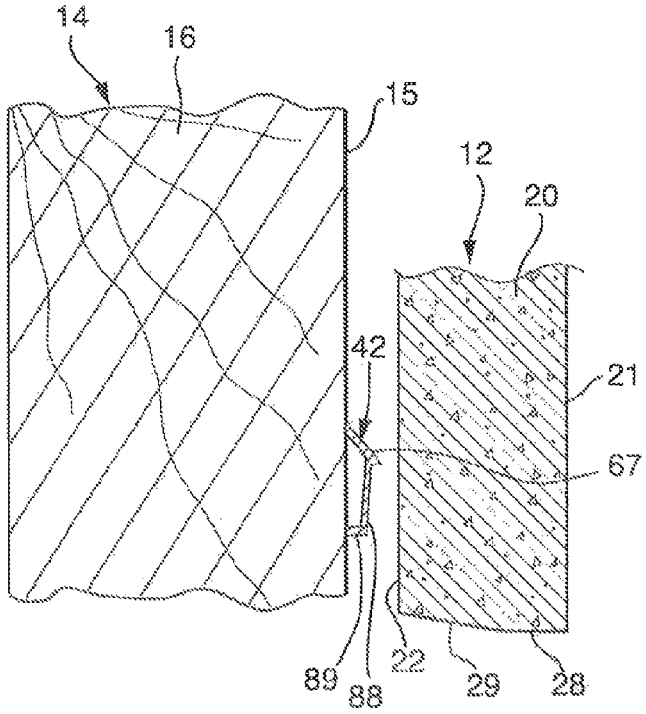
FIG. 4D is a partial cross-sectional view of the supporting spacer, taken along line 4D-4D in FIG. 3.

The supporting spacer 40 further includes the water management portion 60, which includes at least one channel or trough 64 for capturing water which has infiltrated at the top edge 26 all the way to the back surface 22 and at least one conduit 66 for draining the infiltrated water from the trough 64 out of contact with the building structure (see FIGS. 2B, 3 and 4A to 4D). This trough is formed by an L-shaped mounting panel 50, embedded with one leg into the back surface 22 of the facing panel 20. The conduit 66 is formed as a U-shaped channel having both legs embedded into the back surface 22 of the facing panel 20 to seal the conduit along the rear surface. The L-shaped mounting panel 50 of the water management portion 60 has a vertical leg 51 sandwiched with the metal plate 43 to form the mounting flange 46 and a horizontal leg 52 having its end embedded into the facing panel 20 below the top edge 26. Thus, the trough 64 is defined by the L-shaped panel 50 and the back surface 22 of the facing panel 20. As is readily apparent from FIG. 4B, any water which passes through the seam between the vertically stacked facing panels 20 between the top edge 26 and the bottom edge 28 and all the way to the back surface 22 will be captured in the trough 64 and maintained away from the building structure 14. As illustrated in FIGS. 2B and 3, the trough 64 extends essentially all the way across the siding panel from the first side edge 30 of the facing panel 20 to the second side edge 32 of the facing panel 20 along the top edge 26 to form a trough 64 extending substantially over the full width of the facing panel. The horizontal leg 52 which forms the base of the trough 64 is provided with at least one drainage aperture 65 connected with the drainage conduit 66. Preferably, the floor of the trough 64 is inclined from horizontal to slope downward towards the drainage aperture 65, as illustrated in FIGS. 2B and 3. The U-shaped conduit 66 extends sufficiently downward towards the bottom edge of the facing panel 28 to guide the drained water into the trough 64 of a like siding panel 12 positioned immediately below. The floor of the U-shaped conduit 66 is preferably provided at its bottom end 68 with a ramp 67 inclined towards the back surface 22 in order to deflect drained water exiting the conduit 66 away from the building structure 14 and towards the back surface 22.

The drainage conduit 66 preferably further includes anchoring tabs 62 embedded in the facing panel 20 to fasten the drainage conduit to the panel. Although the anchoring tabs 62 are generally sufficient to achieve a secure connection with the facing panel, the legs of the U-shaped conduit 66 are preferably also partially embedded into the rear surface 22 of the facing panel 20 to seal the conduit along the rear surface and avoid lateral leakage of drained water from the conduit.

The mounting and water management portions 42, 60 also function to space the facing panel 20 at a constant distance from and parallel to the supporting surface 15. The distance is determined by the width of the L-shaped mounting panel 50 and the depth of the U-shaped conduit 66.

In the preferred embodiment illustrated in FIGS. 2B, 3, 5A, 6 and 7, the water management portion 60 includes a trough 64 with three drainage apertures 65 and three associated drainage conduits 66 respectively placed towards the first and second side edges 30, 32 and at a location centrally therebetween. Most preferably, one of the U-shaped drainage conduits 66 is placed directly at one of the end edges 30, 32 and extends beyond the associated end edge in order to overlap the joint between the siding panel and a like siding panel placed immediately beside. This enables the capture of infiltrated water all around the facing panel in the installed condition, since the overlapping U-shaped conduit 66*a* together with the trough 64 form a continuous trough which extends along the top edge and a side edge and therefore captures water infiltrated along the top and bottom edges 26, 28 or the side edges 30, 32 in the installed condition.

The supporting spacer 40 preferably also includes an installation aid in the form of interengageable upper and lower coupling elements for coupling of the bottom edge of one siding panel during installation to the top edge of another siding member directly below. These upper and lower coupling elements are provided in the form of a lower coupling flange 88 extending across the bottom of the supporting spacer 40 and connecting the bottom ends 68 of the conduits 66, and multiple upstanding upper coupling tabs 82 extending upward from the mounting flange 46 and defining a U-shaped gap 85 with the vertical supporting surface 15 for fittingly receiving the coupling flange 88 (FIG. 7). The coupling flange 88 is secured to the facing panel 20 by multiple anchoring tabs 62 embedded into the rear surface 22 (see FIGS. 3, 4A to 4D and 6. A bottom edge 89 of the coupling flange 88 extends parallel to a top edge 41 of the mounting flange 46 and the coupling flange 88 is positioned on the rear surface 22 in proximity to the bottom edge 28, for the bottom edge 89 of the coupling flange 88 to rest in the installed condition of the siding panel 12 against the top edge 41 of the mounting flange 46. This automatically aligns vertically stacked siding panels 12 in parallel.

Wind pressure on the building structure 14 may create significant pressure differences between the exterior of the building siding and the rear of the siding. Moreover, localized pressure peaks may be created behind the siding structure during gusty wind conditions. Therefore, steps are normally taken to equalize those pressure differences in an effort to reduce infiltration of water through the siding and potential entrapment of the infiltrated water behind the siding. In the illustrated embodiment of the siding panel of the invention, the mounting panel 50, conduits 66 and coupling flange 88 form a continuous band of contact with the supporting surface 15 of the building structure 14, thereby forming air pockets between the supporting surface 15 and the facing panel 20. These air pockets behind the facing panel 20 may lead to an undesirable pressure differential between the front and rear sides of the siding panels during inclement weather conditions. In order to prevent such a pressure differential, at least one of the conduits 66 adjoining the air pocket in the installed condition is provided with a pressure vent 102. The pressure vent 102 is an opening in a sidewall of the U-shaped conduit 66. Preferably, the opening is provided with an overlapping lip 104, which is upwardly inclined in the installed condition of the siding panel 12, in order to minimize the potential for leakage of the drained, infiltrated water from the vent 102.

It is generally desired with modular sidings including stacked siding panels to shape and size the panel front surfaces to generate a continuous, uninterrupted siding surface when the siding panels are stacked. However, that may again increase the chance of localised pressure differences behind the siding. To minimize the chance of any pressure build-up behind the installed siding, the siding panels in accordance with the invention preferably include facing panels which are shaped and sized to tightly abut at their side edges with adjacent facing panels in the stacked condition, while a spacing or gap between the installed facing panels is always present at the top and bottom edges (see FIGS. 6 and 7). This top and bottom gap provides a pressure equalization vent for each individual siding panel in the installed condition, rather than pressure vents at select locations, as in conventional masonry sidings. However, in order to achieve the appearance of a continuous siding surface, at least part of the top and bottom edges of the facing panels are shaped to extend at an angle other than perpendicular to the front face, thereby cutting the line of sight through the top and bottom gaps. This visually masks the presence of the top and bottom gaps.

The water management portion 60 is preferably made of a plastics material which is moulded as a single part including the L-shaped mounting panel 50 with the coupling tabs 82, the U-shaped conduits 66 and the coupling flange 88. Most preferably, the water management portion 60 is moulded onto the mounting portion 42 so that during the moulding process the plastics material of the water management portion 60 extends into the apertures 47 of the metal plate 43. This interlocks the two portions of the supporting spacer 40 and effectively shields the metal plate 43 from exposure to infiltrated water, thereby potentially extending the service life of the siding panel 12.

Figure 5A:
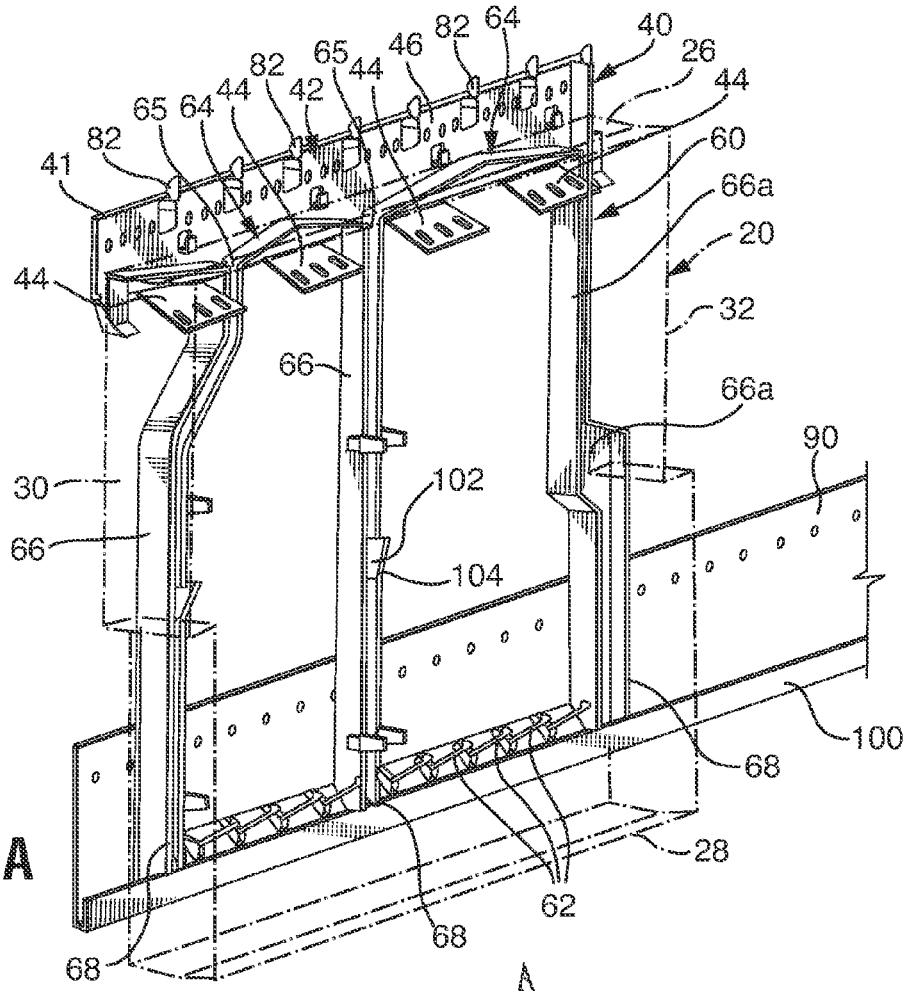
FIG. 5A is a perspective view similar to FIG. 2B, illustrating the mounting of the first row of siding panels by way of a starter rail.
Figure 5B:
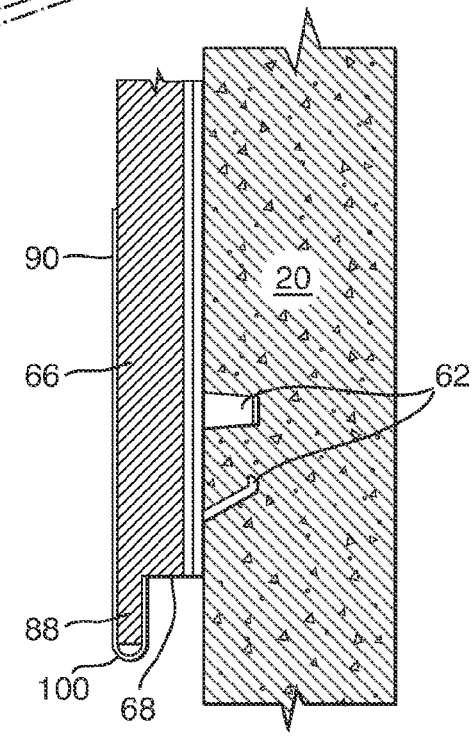
FIG. 5B is a partial cross-sectional view of the supporting spacer and starter rail, taken along line 5B-5B in FIG. 5A.

In order to start the installation of the siding from the base of the vertical support surface, a horizontal starter rail 90 is installed as shown in FIGS. 5A and 5B. The starter rail 90 has a U-shaped coupling member to receive the coupling flange 88 of a siding panel 12.

In practice, the siding panels 12 are manufactured in accordance with the structure described above. The vertical support surface 42 to which the siding panels 12 are to be secured is identified and the studs 98 (or other support members of the vertical support surface) are identified. The starter rail 90 is secured horizontally to the vertical supporting surface 42 and siding panels 12 are placed thereon side-by-side with the downwardly extending coupling flanges 88 seated within the U-shaped coupling member 100 of the starter rail 90. The first and second side edges 30, 32 of the facing panels 20 of adjacent siding panels 12 are mated and each siding panel 12 is secured in place by applying fasteners through the mounting flange and into one of the studs. Once a first row of siding panels has been installed in this manner, the next row of the siding panels 12 is installed by inserting the coupling flange 88 behind the coupling tabs 82 of the mounting flange 46 of the row of panels immediately below. This process is repeated for subsequent rows until the siding surface is completed.

With the foregoing in mind, the present self-supporting modular siding system 10 allows quick, easy and economical installation. Each siding panel 12 is fully supported by its own mounting flange. No mortar is required for installation. A lightweight concrete mix is preferably used in the manufacture of the siding panels 12 to allow for easy handling of the various side panels 12. In addition, profiles of the first and second side edges allow building interlocking corners using the same unit. The side face of the module is preferably textured similar to the facing surface 21 to imitate the face of the module for all corners.

In accordance with the preferred invention, each panel is 12 inches high, 24 inches wide and 1.5 to 2 inches thick. In the Z-shaped embodiment, the panel is further provided with a matching offset at each end equal in length to the thickness of the panel, to achieve the Z-shaped connection member.

While the preferred embodiments have been shown and described, it will be understood that there is no intent to limit the invention by such disclosure, but rather, is intended to cover all modifications and alternate constructions falling within the spirit of and scope of the invention.

What is claimed is:

1. A siding panel for the assembly of a mortarless modular siding on a building structure, comprising:

a facing panel made of a settable material and having a facing surface exposed in an installed condition of the panel, a rear surface facing the building structure in the installed condition, and top, bottom and side edges for proximal placement to like panels positioned adjacent thereto;

a supporting spacer partially embedded in the rear surface of the facing panel, the spacer including a mounting portion for fastening the facing panel to the building structure and a water management portion for at least managing infiltrated water which has seeped past the top edge, the water management portion being sealed along the rear surface for draining the infiltrated water between the water management portion and the rear surface such that the infiltrated water drains out of contact with the building structure and away from the building structure.

2. The siding panel of claim 1, wherein the mounting and water management portion are integral portions of the supporting spacer.

3. The siding panel of claim 1, wherein the mounting portion is a metal plate with anchoring tabs embedded into the facing panel and the water management portion is a plastics structure with anchoring tabs embedded into the facing panel.

4. The siding panel of claim 1, wherein the water management portion engages the rear surface along the top edge to define a trough for capturing the infiltrated water.

5. The siding panel of claim 4, wherein the trough extends substantially over a whole width of the facing panel.

6. The siding panel of claim 4, wherein the trough further extends along one of the side edges for capturing water which has seeped past that side edge.

7. The siding panel of claim 6, wherein the water management portion defines a U-shaped trough together with the rear surface of the facing panel, for capturing water drained from the drainage conduit of a siding panel positioned directly above.

8. The siding panel of claim 4, wherein the trough includes a drainage opening and the water management portion further includes a drainage conduit connected to the drainage opening for channelling water flowing through the drainage opening toward the bottom edge.

9. The siding panel of claim 1, wherein the supporting spacer includes a mounting flange formed by overlapping sections of the mounting and water management portions, for reinforcement of the supporting spacer at the point of securement to the building structure.

10. The siding panel of claim 9, wherein the mounting flange extends along a top edge of the siding panel and the supporting spacer further includes coupling elements for slidingly coupling the bottom edge of the siding panel with the mounting flange of a like siding panel positioned immediately below.

11. The siding panel of claim 10, wherein the coupling elements include a lower coupling element positioned at a bottom end of the supporting spacer for engaging a top edge of the mounting flange of a like siding panel placed immediately below, and an upper coupling element extending upward from the mounting flange for gripping around the lower coupling element of another like panel placed immediately above.

12. The siding panel of claim 11, comprising a plurality of upper coupling elements, wherein the lower coupling element is a coupling flange integrated into the water management portion for placement onto an upper edge of the mounting flange of a like siding panel placed immediately below and the upper coupling elements are coupling tabs evenly spaced along the mounting flange for slidingly gripping the coupling flange of a like siding panel placed immediately above.

13. The siding panel of claim 11, wherein the mounting flange and coupling flange are parallel for automatic horizontal alignment of horizontally stacked like panels.

14. The siding panel of claim 1 wherein the water management portion extends from the top edge towards the bottom edge.

15. The siding panel of claim 1 wherein the water management portion is provided between the building structure and the rear surface in the installed condition of the panel.

16. A mortarless modular siding, comprising stacked rows of siding panels as defined in claim 1.

17. The modular siding of claim 16, further comprising a starter rail for supporting a lowermost horizontal row of the siding panels.

18. The modular siding of claim 17, wherein the starter rail includes a U-shaped supporting flange for receiving the coupling flange of the siding panels in the lowermost row.

19. The modular siding of claim 16, wherein the facing panels have a rectangular outline, or a Z-shaped outline with interlocking end portions.

20. The modular siding of claim 16, wherein the side edges of the facing panels tightly abut the side edges of laterally adjacent panels, while the top edges of each facing panel is closely spaced from the bottom edge of a like facing panel immediately above for generating an intermediate pressure equalization gap extending from the front surface to the back surface for each individual siding panel.

21. A method of mounting a modular siding on a building structure, comprising the steps of:

obtaining multiple siding panels as defined in claim 10;

mounting a first horizontal row of at least two side by side siding panels on the building structure; and installing subsequent rows of like siding panels by interlocking the bottom edge of each siding panel with the mounting flange of the horizontal row of panels, sliding the siding panel on the horizontal row to a desired location adjacent another like panel and fastening the mounting flange of the siding panel to the building structure.

22. The method of mounting as defined in claim 21, further comprising the initial step of fastening a horizontal starter rail to the building structure for supporting the first horizontal row of siding panels.

* * * * *